US005340345A

United States Patent [19]

Brodbeck et al.

[11] Patent Number: 5,340,345

[45] Date of Patent: Aug. 23, 1994

[54] WATER PICKUP AND COOLING APPARATUS FOR BOAT DRIVE SYSTEMS

[75] Inventors: John W. Brodbeck; William J. Brunsting, both of Lake Havasu City, Ariz.

[73] Assignee: K & B Mfg, Inc., Lake Havasu City, Ariz.

[21] Appl. No.: 98,413

[22] Filed: Jul. 26, 1993

[51] Int. Cl.[5] ..... B63H 5/12

[52] U.S. Cl. ..... 440/88

[58] Field of Search ..... 440/88; 123/41.63, 41.73, 123/41.82 R; 62/DIG. 10

[56] References Cited

U.S. PATENT DOCUMENTS

| | | | |
|---|---|---|---|
| 1,099,684 | 6/1914 | Barlow et al. | 440/88 |
| 2,627,242 | 2/1953 | Kiekhaefer | 114/183 R |
| 2,672,114 | 3/1954 | McCartney | 440/89 |
| 3,029,769 | 4/1962 | Kiekhaefer . | |
| 3,240,181 | 3/1966 | Chandler et al. | 440/88 |
| 3,650,310 | 3/1972 | Childress . | |
| 4,074,651 | 2/1978 | Arduser | 114/183 |
| 4,075,969 | 2/1978 | Griffin | 440/88 |
| 4,371,351 | 2/1983 | Tousey | 440/88 |
| 4,595,372 | 6/1986 | Hebert | 440/88 |
| 5,061,214 | 10/1991 | Monaghan | 440/88 |

*Primary Examiner*—Jesus D. Sotelo

*Attorney, Agent, or Firm*—Knobbe, Martens, Olson & Bear

[57] ABSTRACT

An apparatus for cooling a stern mounted drive on a boat, comprising a water pickup for gathering water from the body of water in which the boat is operating, and a spray nozzle that directs a stream of cooling water towards the outer surface of the housing containing the drive assembly gears and shafts. The drive assembly of a typical stern drive for a boat is the linkage that transmits the power generated by the engine to the propeller. To remove the excess frictional heat generated within the drive assembly under high horsepower operation. The drive assembly cooling apparatus collects water through a water intake opening when the boat is moving forward through the water. A lip formed adjacent the intake opening assists in directing the water into the opening, and forcing the water up to and through the spray nozzle. The cooling water is discharged through an opening in the spray nozzle, and is directed towards the rear surface of the drive assembly housing. Additionally, a spray direction plate may be mounted on the drive assembly housing to assist in the distribution of the cooling water over the outer surface of the drive assembly housing.

18 Claims, 3 Drawing Sheets

WATER PICKUP AND COOLING APPARATUS FOR BOAT DRIVE SYSTEMS

BACKGROUND OF THE INVENTION

1. Field of the Invention

The present invention generally relates to a system for cooling components in nautical engines and, in particular, is concerned with a system that cools an externally mounted drive assembly by spraying water collected from the body of water in which the boat is operating on the outer housing of the drive assembly.

2. Description of the Related Art

Most stern drives for propelling boats have three basic components, a motor turning a drive shaft, a drive assembly that is used to transmit the power developed by the motor, and a propeller that receives the engine power from the drive assembly. Typically, for most inboard or inboard/outboard stern drives, the engine is mounted inside of the boat and the housing containing the drive assembly is mounted on the outside of the boat, above the water-line.

The drive assembly will normally include a series of gears that transmit the torque developed by the engine on the drive shaft to a shaft driving the propeller, i.e., the propshaft. The drive assembly is preferably mounted within a watertight housing, and is filled with oil to provide lubrication for the moving gears and shafts. When the motor is operating, frictional forces resulting from interaction between the gears and shafts of the drive assembly generate heat within the housing. As can be appreciated, the frictional heat generated within the housing increases as the boat operates at higher RPMs and power settings.

Unfortunately, excessive heat within the drive assembly will ultimately result in damage to either the gears or shafts, reducing their operating life and necessitating replacement of the drive assembly. In high performance boat engines, replacement of the drive assembly can become prohibitively expensive. Hence, the ability to dissipate the frictional heat developed within the drive assembly housing is desirable to prolong the operational life of the drive assembly.

One particularly useful method of providing cooling for nautical engines and drive components involves taking water from the body of water in which the boat is operating and using this water for cooling purposes. U.S. Pat. No. 4,075,969 provides one example of where water is taken from a lake or ocean and is then used for purposes of cooling the boat's motor.

In addition to its function as a heat transfer medium, other systems have been developed that take water from the lake in which the boat is operating for various other purposes. Specifically, U.S. Pat. No. 4,595,372 discloses a water ejector and injector attachment that includes an opening in the skeg of the boat's engine-mounted trim tab. This attachment however is designed to supply water to, and remove water from, a piping system, preferably connected to the bilge(s) of the boat. The water is collected and removed from the piping system via the ejector/injector attachment using water pressure forces resulting from the movement of the boat through the water.

A need exists in the prior art for a simple apparatus which provides cooling for the drive assembly. Heretofore, while some of the prior art references teach taking water from the lake in which the boat is operating to cool the boat's motor, none of the references of which applicant is aware, teach using this water to cool the drive assembly of the boat's stern drive. Preferably, this inventive apparatus should be readily adaptable to existing boat stern drives and capable of taking water from the lake in which the boat is operating to cool the drive assembly without requiring the use of mechanical pumps, to thereby minimize the cost of the apparatus.

SUMMARY OF THE INVENTION

The aforementioned needs are addressed by the present invention, comprising an apparatus for taking water from the body of water in which the boat is moving and projecting a stream of water at the outer housing for the drive assembly mechanism that links the drive shaft of the engine to the propshaft. This apparatus includes: a water pick up for taking water from the lake when the boat is in motion, positioned underwater, adjacent to the skeg of the boat's trim tab; a spray head or nozzle having an opening directed at the outer housing of the drive assembly; and a shaft or tube connecting the water pick up to the spray nozzle.

This apparatus operates as follows: when the boat is in motion, water enters through the water pick up, is then forced upwards by the pressure head created by the motion of the boat through the water, passes through the connecting shaft and into the spray head for discharge from the opening in the spray head towards the outer housing of the drive assembly. The water impacting on the outer housing of the drive assembly has the effect of cooling the oil bath within the housing, which in turn cools the gears and shafts located therein. Specifically, the drive assembly is immersed in oil and the frictional heat resulting from the operation of the drive assembly is transmitted through the oil to the drive assembly's housing. Consequently, spraying water on the outer housing of the drive assembly has the effect of removing excess heat from the drive assembly, thereby prolonging its operational life.

Another aspect of the present invention is a spray shield mounted on the exterior housing containing the drive assembly. The spray shield further directs the water sprayed on one surface of the drive assembly housing by the spray head, to a second surface of the housing to thereby maximize the removal of excess frictional heat.

A further aspect of the present invention is a water pick up which is formed in a standard galvanic trim tab plate, a shaft that extends through the boat's cavitation plate, and a spray head coupled to the shaft mounted on the upper surface of the cavitation plate, which receives water collected by the water pick up and sprays it at the drive assembly housing. This aspect of the present invention is readily adaptable to existing boat engines and drive assemblies by simply installing a water pick up immediately adjacent to the skeg on a readily available galvanic trim tab and replacing trim tab's mounting shaft with a hollow shaft, which is then mounted so that it extends through the boat's cavitation plate and thereby connects the water pick up to a spray head mounted on the upper surface of the cavitation plate.

These and other objects and features of the present invention will become more fully apparent from the following description and appended claims taken in conjunction with the accompanying drawings.

DETAILED DESCRIPTION OF THE PREFERRED EMBODIMENT

Reference is now made to the drawings wherein like numerals refer to like parts throughout. The basic components comprising the drive assembly cooling apparatus, and their respective mounting positions, is initially described with reference to FIGS. 1 and 2. The specific components comprising the drive assembly cooling apparatus is then described in greater detail in reference to FIGS. 3, 4 and 5.

Figure 1:
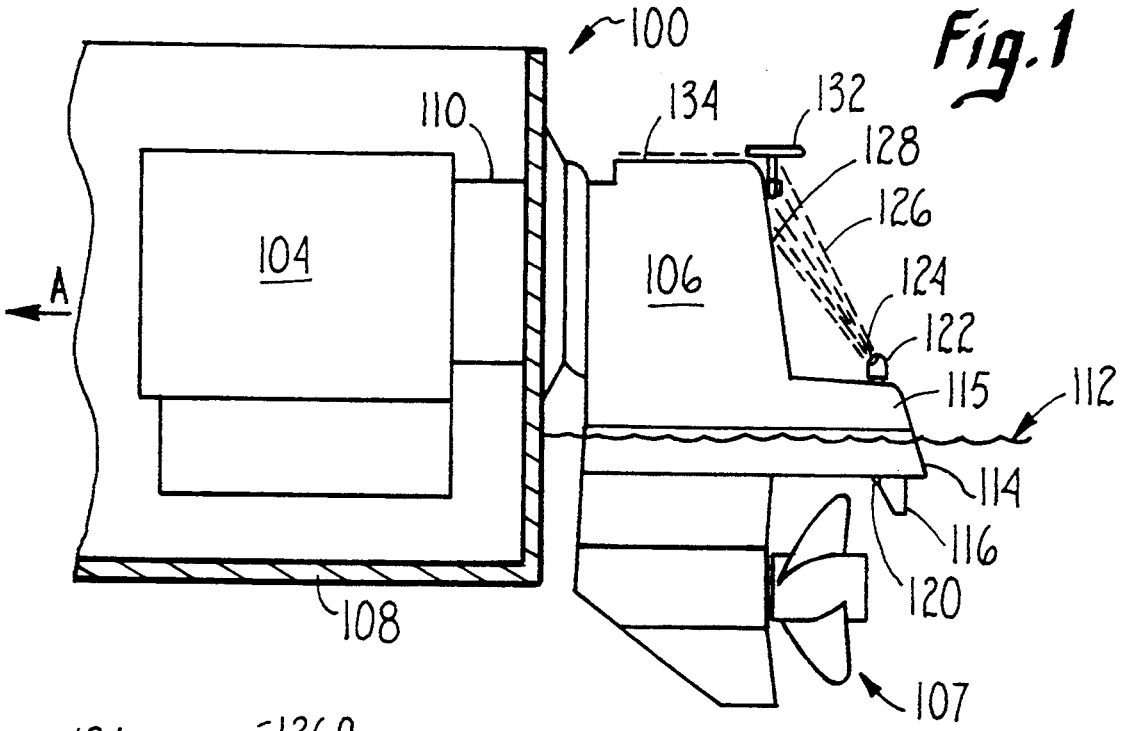
FIG. 1 is a side perspective view of a transom of a boat powered by an inboard/outboard stern drive equipped with the drive assembly cooling apparatus of the present invention.

FIG. 1 initially illustrates an exemplary stern drive 100, comprised of a motor 104, a drive assembly (not shown), contained within a housing 106, and a propeller 107 mounted at the stern end of a boat 108. The motor 104 is positioned within the stern end of the boat 108 with a drive shaft (not shown), contained within a drive shaft housing 110, that extends horizontally through the stern transom of the boat 108. The drive shaft is then coupled to the drive assembly, and the drive shaft housing 110 is also connected to the drive assembly housing 106 in a watertight fashion. The drive shaft then interacts with the gears and shafts of the drive assembly (not shown) so that engine torque is transmitted from the drive shaft to the shaft (not shown) of the propeller 107 causing the propeller 107 to rotate. A waterline 112 is depicted in FIG. 1, providing a reference as to relative positions upon placing the boat in a body of water.

Figure 2:
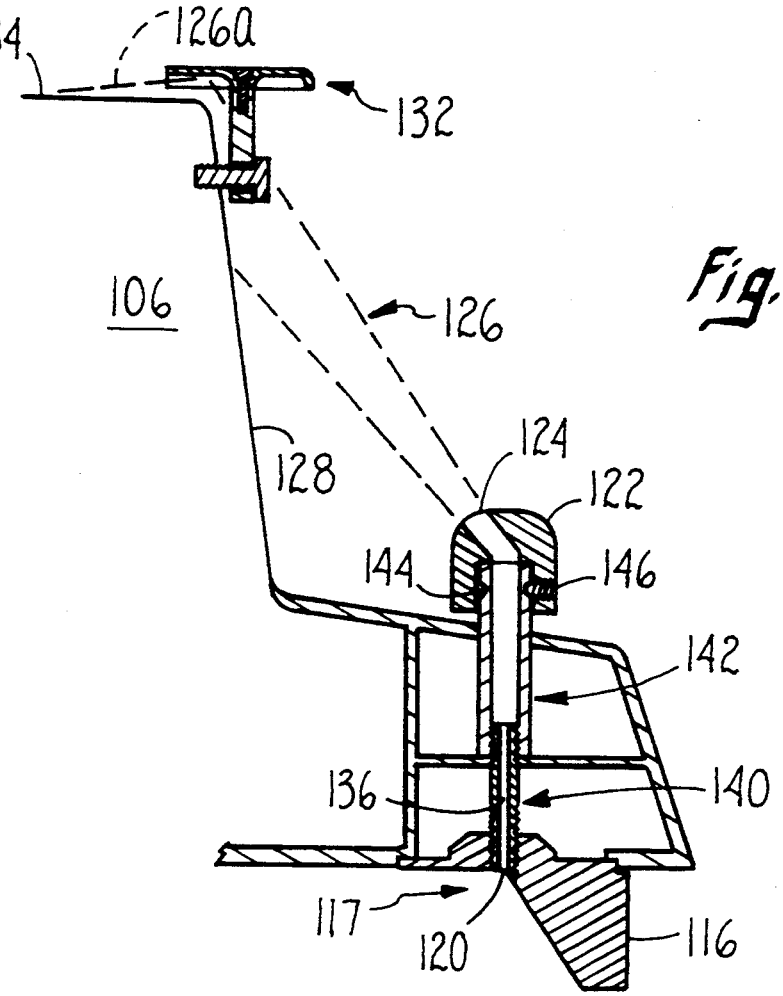
FIG. 2 is a sectional view further illustrating the components comprising the drive assembly cooling apparatus shown in FIG. 1.

The propeller 107 is positioned both underneath the waterline 112, and underneath a cavitation plate 114 that underlies a cavitation housing 115, formed as an extension of the drive assembly housing 106. Mounted on the underside of the cavitation plate 114 is a skeg 116 of an adjustable trim tab 117 (FIG. 2). The skeg 116 provides directional control such that the boat will travel in a straight line when the trim tab 117 is in proper adjustment, absent any turning of the steering wheel (not shown).

The present invention includes a drive assembly cooling apparatus 118 (FIG. 5) that comprises a number of individually-identifiable structures. Mounted immediately forward of the skeg 116 on the adjustable trim tab 117 is a water intake 120. Mounted on an upper surface of the cavitation housing 115 is a spray nozzle 122, having an opening 124 that directs a stream of water 126 (represented by dashed lines in FIGS. 1 and 2) at a rear surface 128 of the drive assembly housing 106 when the boat is travelling in the direction of arrow A. Further, a spray direction plate 132, constituting an additional component of one preferred embodiment of the present invention, is mounted on the rear surface 128 of the drive assembly housing 106 in a manner causing a portion of the stream of water 126 (identified by reference numeral **126*a* in FIG. 2) to be directed onto an upper surface 134 of the drive assembly housing 106**.

FIG. 2 better illustrates the components of the drive assembly cooling apparatus 115, including the aforementioned spray direction plate 132. Specifically, the water intake 120 is located on the trim tab 117 immediately forward of the skeg 116. The water intake 120 opens into a water intake shaft 136, preferably consisting of a hollow trim tab mounting bolt 140. The trim tab mounting bolt 140 is threaded at both ends, and at one end is threadably coupled to the trim tab 117 in a manner such that the trim tab mounting bolt 140 extends completely through the trim tab 117.

A hollow, nozzle mounting shaft 142 is then threadably coupled to the other end of the trim tab mounting bolt 140. The spray nozzle 122 is positioned on the top of the nozzle mounting shaft 142 such that the jet of water 126 is sprayed through the opening 124 and strikes the rear surface 128 of the drive assembly housing 106. In a preferred embodiment, the nozzle mounting shaft 142 has a circumferential indentation 144 located about the nozzle-mounting end of the trim tab mounting bolt 140. Where such indentation 144 is provided, the spray nozzle 122 is secured to the trim tab mounting bolt 140 by a set screw 146 tightened into the indentation 144.

Preferably the opening 124 of the spray nozzle 122 is configured to direct a stream of water to impact on the rear surface 128 of the drive assembly housing 106, as shown in FIGS. 1 and 2. Further, the spray direction plate 132 is bolted to the rear surface 128 of the housing 106 in a manner such that a portion of the stream of water 126 can directly or indirectly impact upon the bottom surface of the spray direction plate 132. The spray direction plate 132 then directs this portion of the sprayed water onto the top surface 134 of the drive assembly housing 106, as is also shown in FIGS. 1 and 2.

Figure 3:
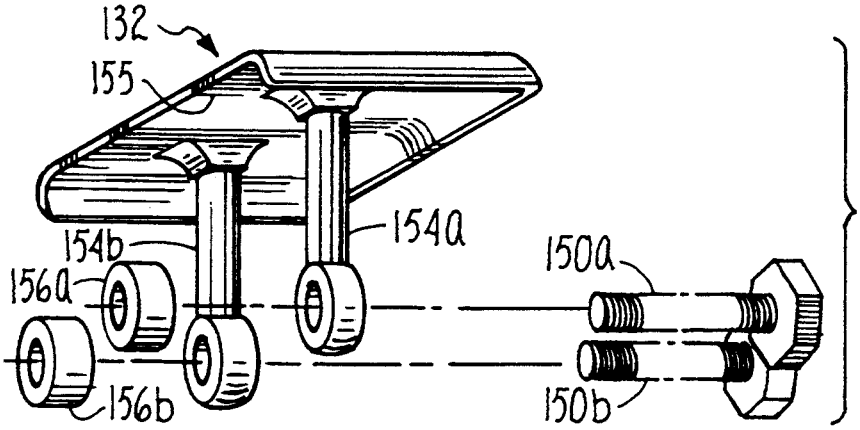
FIG. 3 is an exploded perspective view illustrating the water direction plate of the drive assembly cooling apparatus shown in FIGS. 1 and 2.

FIG. 3 illustrates the spray direction plate 132 and its mounting components in greater detail. In a preferred embodiment, the spray direction plate 132 is substantially rectangular in shape and has concave flanges along three of its four edges. The spray direction plate 132 is preferably made out of a non-corrosive metal, such as stainless steel, and has dimensions of approximately 2 inches by 4.25 inches with a thickness of 0.375 inches and a flange of 0.312 inch radius. When the spray direction plate 132 is appropriately mounted on the housing 106 (FIGS. 1 and 2), the flangeless edge is preferably positioned immediately above the upper surface 134 of the housing 106.

The spray direction plate 132 is secured to the rear surface 128 of the drive assembly housing 106 by a pair of plate mounting bolts **150*a*, 150*b*, which extend through a corresponding pair of openings 152*a*, 152*b* formed in a pair vertical members 154*a*, 154*b*. The vertical members 154*a*, 154*b* are connected to a bottom surface 155 of the spray direction plate 132, and extend perpendicularly downward from this surface approximately 2 inches. The vertical members 154*a*, 154*b* are also made out of a non-corrosive metal such as stainless steel. The mounting bolts 150*a*, 150*b* pass through the openings 152*a*, 152*b* in the vertical members 154*a*, 154*b*** and are received by a pair of threaded holes (not shown) formed in the rear surface of the housing 128.

A pair of spacers 156a, 156b are respectively mounted on each of the mounting bolts 150a, 150b between the vertical members 154a, 154b and the rear surface 128 of the drive assembly housing 106, to ensure that the spray direction plate 132 is appropriately positioned away from the drive assembly housing 106. The completed attachment of the spray direction plate 132 is shown in FIG. 2. As can be appreciated, the exact dimensions and positioning of the spray direction shield 132 varies between different configurations of stern drives depending upon the location of the drive assembly housing 106, and the direction of the stream of water 126.

Figure 4:
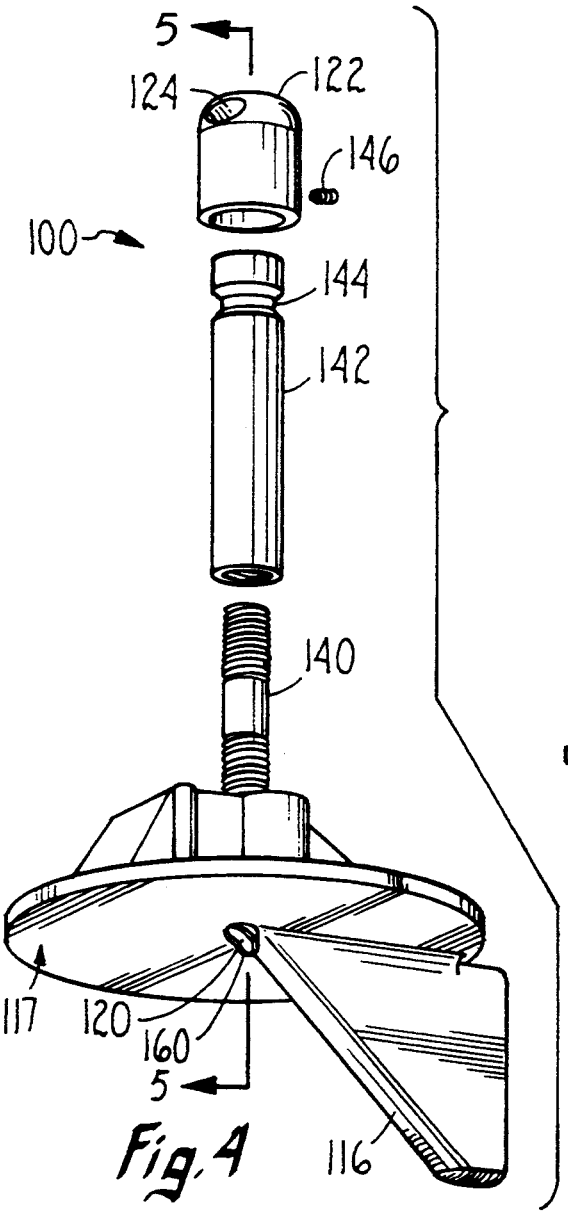
FIG. 4 is an exploded perspective view illustrating a trim tab, a shaft and a spray head of the drive assembly cooling apparatus shown in FIGS. 1 and 2.
Figure 5:
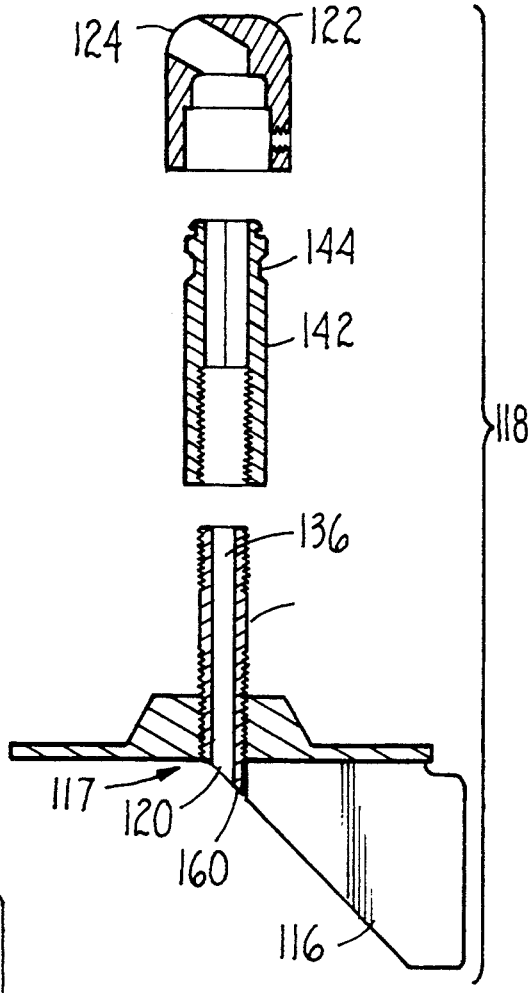
FIG. 5 is a sectional view of the trim tab, shaft and spay head taken along line 5—5 in FIG. 4.

FIGS. 4 and 5 further illustrate the components of the drive assembly cooling apparatus 118 that gather water from a body of water (e.g. ocean, lake, and/or river) and spray it on the surface of the drive assembly housing 106 when the boat is in forward motion. As is shown in FIG. 4, the water intake 120 includes a lip 160 that extends in a perpendicular manner downward from the surface of the galvanic trim tab 117 adjacent to the skeg 116. Preferably, the lip 160 is formed on the skeg 116 by routing the front tip of the skeg 116 adjacent to the opening for the trim tab mounting shaft 140. The lip 160 and the water intake 120 are thereby advantageously configured to collect water when the boat is in motion yet minimize any additional drag on the boat resulting from the addition of the water intake 120. When the boat is travelling through the water in the direction of the arrow A (FIG. 1), the lip 160 is believed to act as a scoop to collect water and force it upward into the water intake shaft 136, then into the nozzle mounting shaft 142, and finally, the water is ultimately ejected out of the spray nozzle 122 through the opening 124. As a person skilled in the art can appreciate, the water pick up will work as well with a flat plate, such as a galvanic plate, as it does with a trim tab having a skeg.

The spray nozzle opening 124 is preferably circular with a diameter of 0.375 inches and is appropriately angled to permit water to be sprayed in a stream on the drive assembly housing 106. The precise angle is dependent upon the particular engine and drive assembly apparatus in use. For example, an angle of approximately 40 degrees has been found to be appropriate when the drive assembly cooling apparatus 118 is installed on a MerCruiser "ALPHA" stern drive, and an angle of approximately 50 degrees is appropriate when the drive assembly cooling apparatus 118 is installed on a MerCruiser "BRAVO" stern drive assembly housing. In such a preferred embodiment, the water intake 120, the water intake shaft 136, the nozzle mounting shaft 142, and the spray nozzle 122 are each suitably dimensioned so as to be capable of producing cooling water flow rates of approximately three (3) gallons of water per minute from the spray nozzle opening 124 when the boat is travelling at approximately 40 miles per hour.

Further, in this particular preferred embodiment, the components comprising the drive cooling apparatus 118 are dimensioned to be installed on a MerCruiser 7.4 Liter BRAVO stern drive manufactured by Buinswick Marine of Oshkosh, Wis. Specifically, the replaceable galvanic trim tab 117 of the MerCruiser 7.4 Liter BRAVO stern drive has been modified to include the water intake 120 and the hollow trim tab mounting bolt 140. The hollow trim tab mounting bolt 140 extends into an existing opening in the cavitation plate 114 (FIGS. 1 and 2). The nozzle mounting shaft 142 is then threadably coupled to the upper threads on the trim tab mounting bolt 140 such that the nozzle mounting shaft 142 extends out of an existing opening in the upper surface of the cavitation plate 114. In this particular embodiment, the nozzle mounting shaft 142 is approximately 3.7 inches long, having a 0.7 inch diameter. The spray nozzle 122 then flushly mounts on the top of the nozzle mounting shaft 142 in the previously described manner.

Hence, the drive assembly cooling apparatus 118 can be readily installed onto any stern drive having this basic configuration. Further, the configuration of the MerCruiser 7.4 Liter BRAVO stern drive is typical of the configuration of any of a number of stern drives manufactured by MerCruiser and its subsidiaries. Consequently, the above described configurations and dimensions for the components of the drive assembly cooling system can be used on many different MerCruiser high performance drives. Additionally, as a person skilled in the art can appreciate, the dimensions and placement of the components of the drive assembly cooling apparatus 118 described herein can also be modified to fit within any number of stern drives of other makes and manufacturers, having a drive assembly housing so located as to permit conveyance of cooling water to the outer surface thereof.

The operation of the drive assembly cooling apparatus 118 with the spray direction plate 132 will now be described with reference to FIGS. 1, 2, and 4. When the boat is travelling in the direction of the arrow A (FIG. 1), water is directed into the water intake 120 by the lip 160. The forward motion of the boat creates a pressure head that forces this water upwards through the water intake shaft 136 formed within the trim tab mounting bolt 140 and the hollow nozzle mounting shaft 142. The flow of water continues into the nozzle 122, whereupon it is forced out through the nozzle opening 124, forming the stream of water 126 that strikes against the rear surface 128 of the drive assembly housing 106. In a preferred embodiment of the present invention, a portion of the stream of water 126a impacts on the bottom surface 155 of the spray direction plate 132 and is thereby directed onto the top surface of the 134 of the drive assembly housing 106.

Figure 6:
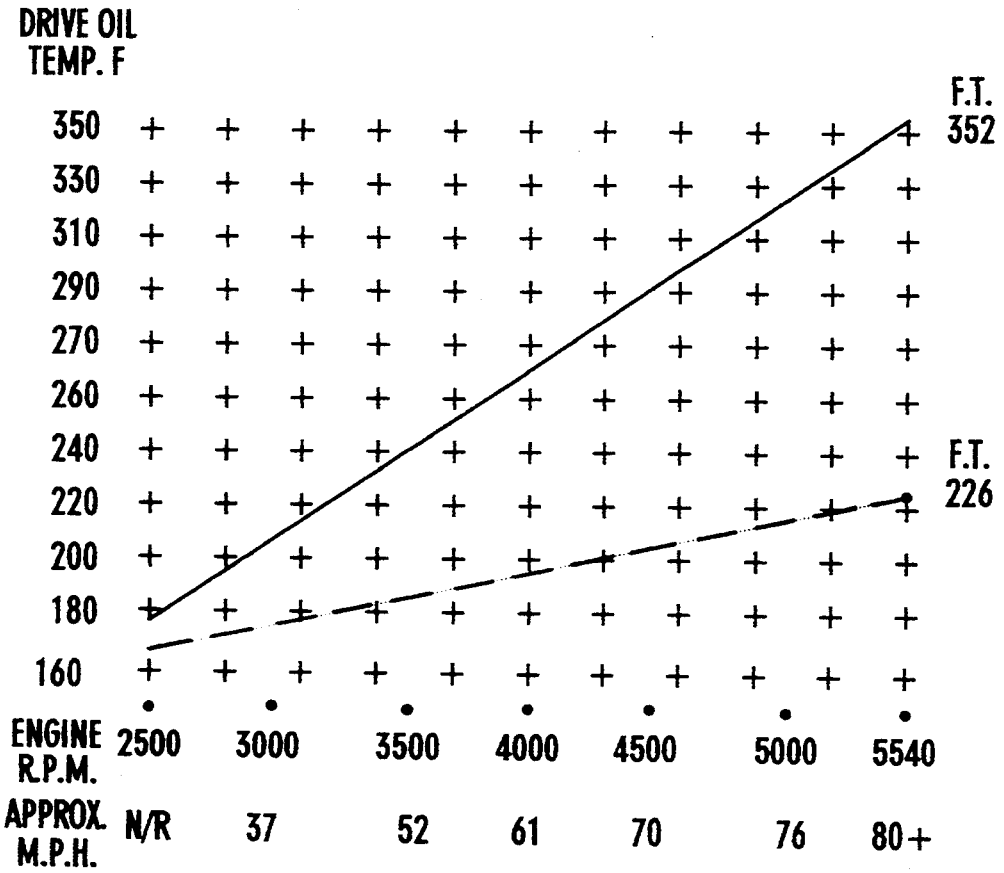
FIG. 6 is a graphical illustration of the cooling effect obtained by a stern drive equipped with the apparatus shown in FIGS. 1 and 2.

When the boat is in operation, frictional forces in the drive assembly heat the oil bath within the drive assembly housing 106. This heat is transmitted to the outer surface of the housing 106, and is the removed via the stream of cooling water 126. As is shown in FIG. 6 the drive assembly cooling apparatus 118, in combination with the spray direction plate 132, significantly reduced the temperature of the oil within the drive assembly housing 106 of the tested boat during the operation thereof. FIG. 6 illustrates the temperature of oil measured within the drive assembly during a test using a 600 Horsepower engine driving a $14\frac{3}{4}'' \times 26''$ four blade propeller in calm water, with a water temperature of 76 degrees Fahrenheit and an air temperature of 85 degrees Fahrenheit. The test was conducted by operating the boat at the listed RPMs and speeds for three minutes, and averaging the temperature detected using a LCD temperature probe manufactured by Atkins. The probe was inserted into the drive assembly via the dip stick hole and the tip of the probe was $3\frac{1}{2}''$ below the top of the drive in the center shaft oil passage.

In FIG. 6, the solid line illustrates the temperatures within the drive assembly housing 106 during this test when the drive assembly cooling apparatus 118 was not in operation. These temperatures then correspond to the temperatures that would be expected to occur within the drive assembly housing 106 where no outside cooling mechanism was used. The dashed line illustrates the temperatures within the drive assembly housing 106 during this test when the drive assembly cooling apparatus 118, including the spray shield 132, was in operation. Clearly, the use of the cooling apparatus 118 with the attached spray shield 132 resulted in significantly lower temperatures inside the drive assembly housing 106. Further, greater cooling occurred at higher engine RPMs, specifically at full throttle, where the engine was producing 5,400 RPMs, where there was an one hundred and twenty six degree (126° F.) temperature differential in the interior temperatures, as between the cooled and not cooled drive assembly housings 106.

As shown, the present invention substantially cools the drive assembly housing 106 during high RPM boat operation. Further, the drive assembly cooling apparatus 118 can be fitted on many existing recreational boat drives by simply replacing the galvanic trim tab assembly present on most boat drives with the modified trim tab assembly 117 of the present invention, including the water intake 120 and the spray nozzle 122. Water received from the water intake 120 sprays cooling water on the drive assembly housing 106, and thereby extends the service life of the internal gears and shafts.

Although the preferred embodiment of the present invention has shown, described, and pointed out the fundamental novel features of the invention as applied to this embodiment, it will be understood that various omissions, substitutions, and changes, in the form of the detail of the device illustrated, may be made by those skilled in the art, without departing from the spirit of the present invention.

Specifically, the foregoing description of the preferred embodiments of the present invention have been limited to descriptions of using the drive assembly cooling apparatus in conjunction with stern drives having an inboard/outboard configuration. As a person skilled in the art can readily appreciate, the present invention can be modified to be used with any stern drive having an externally mounted drive assembly including most of the well-known outboard stern drives. Consequently, the scope of the invention should not be limited to the foregoing discussion, but is to be defined by the appended claims.

What is claimed is:

1. An apparatus for cooling a drive assembly linking the drive shaft of a motor to the propshaft driving the propeller of a boat comprising:

a water intake positioned to collect water when the boat is moving through a body of water;

a spray nozzle in fluid communication with said water intake, said spray nozzle receiving said collected water from said water intake and forming same into a stream directed towards a first surface of a housing containing said drive assembly; and a spray direction member positioned adjacent said housing and configured to direct a portion of said stream toward a second surface of said housing.

2. The apparatus of claim 1 wherein said first surface is the rear of said housing and said second surface is the top of said housing.

3. The apparatus of claim 2, wherein said water intake is positioned on a galvanic trim tab adjacent a skeg on said trim tab, said trim tab being located under the waterline on the bottom side of a cavitation plate and said water intake further comprises a lip internally formed in said skeg for collecting water.

4. The apparatus of claim 3, further comprising a hollow shaft connecting said water intake to said spray nozzle.

5. The apparatus of claim 4, wherein said spray nozzle is mounted on an upper surface of said cavitation plate, and said hollow shaft extends through said cavitation plate.

6. The apparatus of claim 5, wherein said spray nozzle sprays water at a rate of approximately three gallons per minute when said boat is travelling at approximately forty miles an hour in calm water.

7. A system for cooling a drive assembly linking the drive shaft of a motor to the propshaft driving the propeller in a boat by cooling the outer surfaces of the housing containing said drive assembly comprising:

means for obtaining water from a body of water in which the boat is travelling;

means for forming said water obtained from said body of water into a steam;

means for directing said stream of water toward a first outer surface of said housing in response to said boat travelling in said body of water; and means for directing a portion of said stream of water onto a second outer surface of said housing.

8. The system of claim 7, wherein said means for directing a portion of said stream of water to a second outer surface of said housing comprises a spray direction plate honed on said housing configured to direct a portion of said stream onto a top surface of said housing.

9. The system of claim 8, wherein said means for obtaining water is comprised of a water intake mounted on a galvanic trim tab positioned under the waterline on the underside of a cavitation plate.

10. The system of claim 9, wherein said means for forming said water into a steam comprises a shaft extending through said cavitation plate to a spray nozzle having an opening.

11. A method of cooling a drive assembly for a boat comprising the steps of:

collecting water from the body of water in which said boat is operating while said boat is moving;

forming at least a portion of the collected water into a stream;

directing said stream of water at a first surface of a housing containing said drive assembly; and directing a portion of said stream of water that is directed at said first surface of said housing toward a second surface of said housing.

12. The method according to claim 11, wherein the water is collected by a water intake having a lip formed in a trim tab positioned adjacent to a skeg mounted on said trim tab.

13. The method according to claim 12, wherein the stream of water is formed by transmitting said water collected by said water intake to a spray nozzle having an opening.

14. The method according to claim 13, wherein the motion of said boat through said body of water causes said water collected by said intake to be transmitted to said spray head and further causes said water to be propelled out of said opening in said spray head in a stream.

15. The method according to claim 11, wherein said first surface is the rear of said housing and said second surface is the top of said housing.

16. The method according to claim 11, wherein said portion of said stream of water is directed onto the top surface by a spray direction shield mounted on said rear surface of said housing.

17. An apparatus for cooling a drive assembly linking the drive shaft of a motor to the propshaft driving the propeller in a boat comprising:

a water intake positioned on a housing containing said propshaft so that said water intake collects water when the boat is moving through a body of water; and a spray nozzle mounted on said housing containing said propshaft, said spray nozzle in fluid communication with said water intake, said spray nozzle receiving said collected water from said water intake and forming same into a stream directed toward a first surface of a housing containing said drive assembly.

18. The apparatus of claim 17, further comprising a spray direction member mounted on said housing and configured to direct a portion of said stream towards a second surface of said housing.

* * * * *